US011677194B2

(12) United States Patent
Smith et al.

(10) Patent No.: US 11,677,194 B2
(45) Date of Patent: Jun. 13, 2023

(54) QUICK DISCONNECT ELECTRICAL CONNECTOR WITH CIRCULAR CONTACTS

(71) Applicant: TE CONNECTIVITY SERVICES GMBH, Schaffhausen (CH)

(72) Inventors: Rodney T. Smith, Middletown, PA (US); Keith Edwin Miller, Middletown, PA (US); Kyle Michael Doll, Middletown, PA (US); Tim Robert Chevalier, Middletown, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 32 days.

(21) Appl. No.: 17/494,257

(22) Filed: Oct. 5, 2021

(65) Prior Publication Data

US 2022/0115811 A1 Apr. 14, 2022

Related U.S. Application Data

(63) Continuation-in-part of application No. 17/066,661, filed on Oct. 9, 2020, now Pat. No. 11,437,748.

(51) Int. Cl.

| | |
|---|---|
| ***H01R 24/38*** | (2011.01) |
| ***H01R 13/62*** | (2006.01) |
| ***H01R 13/627*** | (2006.01) |

(52) U.S. Cl.

CPC ..... *H01R 24/38* (2013.01); *H01R 13/6205* (2013.01); *H01R 13/6277* (2013.01)

(58) Field of Classification Search

None

See application file for complete search history.

(56) References Cited

U.S. PATENT DOCUMENTS

| | | | |
|---|---|---|---|
| 7,056,127 | B2 | 6/2006 | Suzuki et al. |
| 9,281,638 | B2 | 3/2016 | McBroom et al. |
| 10,547,141 | B2 | 1/2020 | Alrashed |

(Continued)

FOREIGN PATENT DOCUMENTS

| | | | |
|---|---|---|---|
| WO | 2019193564 | A1 | 10/2019 |
| WO | 2019193567 | A1 | 10/2019 |

OTHER PUBLICATIONS

Amphenol Ltd., Stingray Magnetic Connector Series, May 2018, pp. 1-8, United Kingdom.

(Continued)

*Primary Examiner* — Ross N Gushi

(57) ABSTRACT

An electrical connector assembly for mating with a mating connector assembly. The connector assembly includes a housing with a cable receiving portion and a mating portion. The housing has a first surface and an oppositely facing second surface. The mating portion has a mating projection which extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts which extend therethrough. The contacts has circular engagement sections arranged concentrically about a center of the mating face. A nonconductive coating applied to the angled wall.

18 Claims, 12 Drawing Sheets

(56) References Cited

U.S. PATENT DOCUMENTS

| | | | | |
|---|---|---|---|---|
| 10,574,006 | B2 * | 2/2020 | Storione | H01R 35/04 |
| 10,777,931 | B2 | 9/2020 | Fukazawa et al. | |
| 2015/0336677 | A1 | 11/2015 | Smaoui et al. | |
| 2021/0075157 | A1 * | 3/2021 | Weigand | H01R 13/17 |
| 2021/0237606 | A1 | 8/2021 | McNair et al. | |

OTHER PUBLICATIONS

International Search Report, International Application No. PCT/IB2021/059219, International Filing Date, Oct. 7, 2020.

* cited by examiner

QUICK DISCONNECT ELECTRICAL CONNECTOR WITH CIRCULAR CONTACTS

CROSS REFERENCE TO RELATED APPLICATIONS

This application claims priority and the benefit of U.S. patent application Ser. No. 17/066,661 filed Oct. 9, 2020 entitled QUICK DISCONNECT ELECTRICAL CONNECTOR WITH CIRCULAR CONTACTS, which is incorporated by reference herein in its entirety.

FIELD OF THE INVENTION

The present invention is directed to a quick disconnect electrical connector with circular contacts. In particular, the invention is directed to an electrical connector which can be easily mated with a mating connector and which can easily breakaway from a mating connector from any direction.

BACKGROUND OF THE INVENTION

Connectors or connector assemblies are often mechanically secured to mating connectors, connector assemblies or panels to prevent the unwanted removal of the connector assembly from the mating connector assembly or panels. Mechanically secured connector assemblies typically employ push-pull, lever-actuated, partial-turn, or other manual locking mechanisms that are designed to release only with specific user intervention initiated directly at the connector interface and are otherwise engineered to hold tight—sometimes withstanding a pull force of dozens or even hundreds of pounds.

However, in many applications there is a need for connectors that are engineered to hold tight up to a predetermined point and then, when that force is reached, smoothly and cleanly let go. Breakaway connectors, which are also known as quick-release or quick-disconnect connectors, are often employed in applications including aviation and military helmets and headsets that attached to consoles or portable equipment with cables, mobile medical monitoring equipment attached to patients, and in other environments in order to prevent cord entanglement, snags, and pulls from hindering or harming the user and equipment they're attached to.

While various breakaway, quick-release or quick-disconnect connectors are currently available, such connectors are generally designed to release when an appropriate force is applied to the cable or connector in a direction which is in line with the longitudinal axis of the connector. However, such connectors fail to properly release if a force is applied to the cable or connector in a direction other than in line with the longitudinal axis of the connector, such as a force applied with a component which is perpendicular to in line with the longitudinal axis of the connector. The inability to release when such a force is applied can cause damage to the equipment and harm to the user.

In addition, many breakaway connectors do not allow mating from any direction. This can cause difficulties, as in many environments, it is difficult to properly align the mating connectors, as connection needs to be done quickly or without a clear line of sight.

It would be, therefore, beneficial to provide an electrical connector or connector assembly which can be easily mated from any direction and which can easily breakaway from a mating connector, connector assembly or panel upon the application of designated force, regardless of the direction the force is applied to the connector or connector assembly.

SUMMARY OF THE INVENTION

An embodiment is directed to an electrical connector assembly for mating with a mating connector assembly. The connector assembly includes a housing with a cable receiving portion and a mating portion. The housing has a first surface and an oppositely facing second surface. The mating portion has a mating projection which extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts which extend therethrough. The contacts has circular engagement sections arranged concentrically about a center of the mating face. A nonconductive coating applied to the angled wall.

An embodiment is directed to an electrical connector assembly for mating with a mating connector assembly. The connector assembly includes a housing with a first surface and a second surface. A mating recess extends from the first surface in a direction toward the second surface. The mating recess has a sloped surface, the sloped surface is sloped relative to a plane of the first surface of the housing. Contacts extend through a bottom surface of the mating recess. The contacts have a resilient mating section which extends from the bottom surface in a direction toward the first surface of the housing. A seal is provided about a circumference of the mating recess. A securing member is provided about the circumference of the mating recess.

An embodiment is directed to a breakaway electrical connector assembly which includes a first connector assembly and a second connector assembly. The first connector assembly has a housing with a cable receiving portion and a mating portion. The housing has a first surface and an oppositely facing second surface. A mating projection extends from the first surface in a direction away from the second surface. The mating projection has a circular cross-sectional configuration. The mating projection has an angled wall which extends from the first surface to a mating face, the angled wall is angled relative to a plane of the first surface and a plane of the mating face. The mating face has contacts extending therethrough, the contacts have circular engagement sections arranged concentrically about a center of the mating face. One or more metallic members are provided on the first surface of the housing proximate the mating projection. The second connector assembly has a second housing with a first surface and a second surface. A mating recess extends from the first surface of the second housing in a direction toward the second surface. The mating recess has a sloped surface, the sloped surface is sloped relative to a plane of the first surface of the second housing. Second contacts extend through a bottom surface of the mating recess. The second contacts have a resilient mating section extending from the bottom surface in a direction toward the first surface of the second housing. A seal is provided about a circumference of the mating recess. A plurality of magnets are provided about the circumference of the mating recess.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
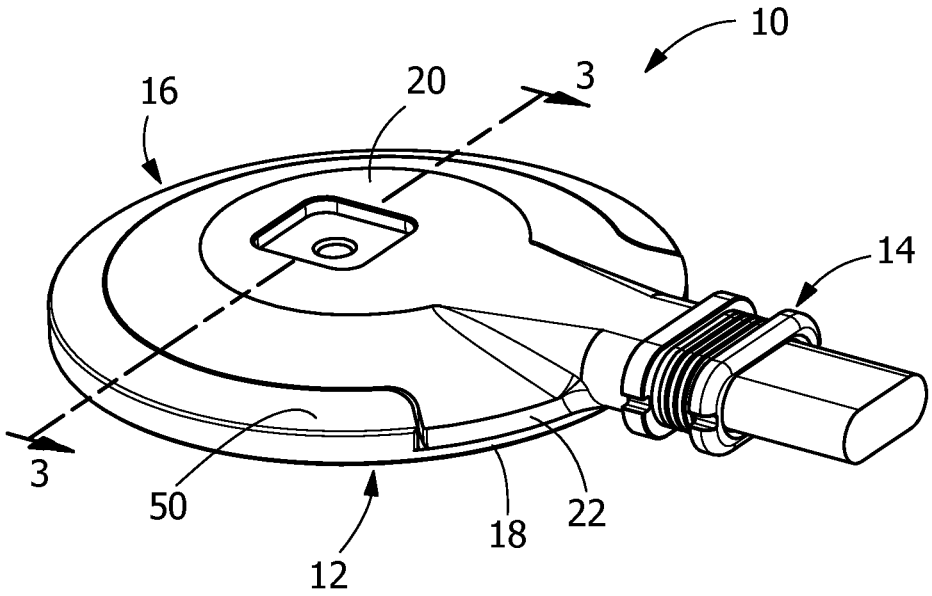
FIG. 1 is a bottom perspective view of an illustrative embodiment of an electrical connector assembly of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
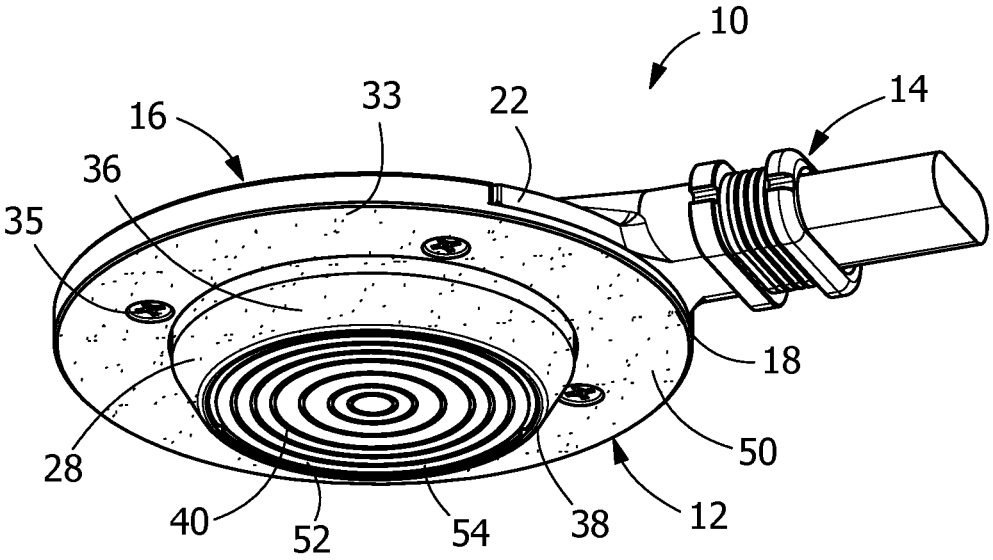
FIG. 2 is a top perspective view of the electrical connector assembly of FIG. 1.

As shown in FIGS. 1 and 2, an illustrative electrical connector assembly 10 has a housing 12 with a cable receiving portion 14 and a mating portion 16. The housing 12 has a first surface 18 and an oppositely facing second surface 20. Sidewalls 22 extend between the first surface 18 and the second surface 20.

In the illustrative embodiment shown, the mating portion 16 has a circular configuration. However, the mating portion 16 may have other configurations without departing from the scope of the invention. The mating portion 16 may be a singular, unitary member or may having more than two housings which form the mating portion 16.

Figure 4:
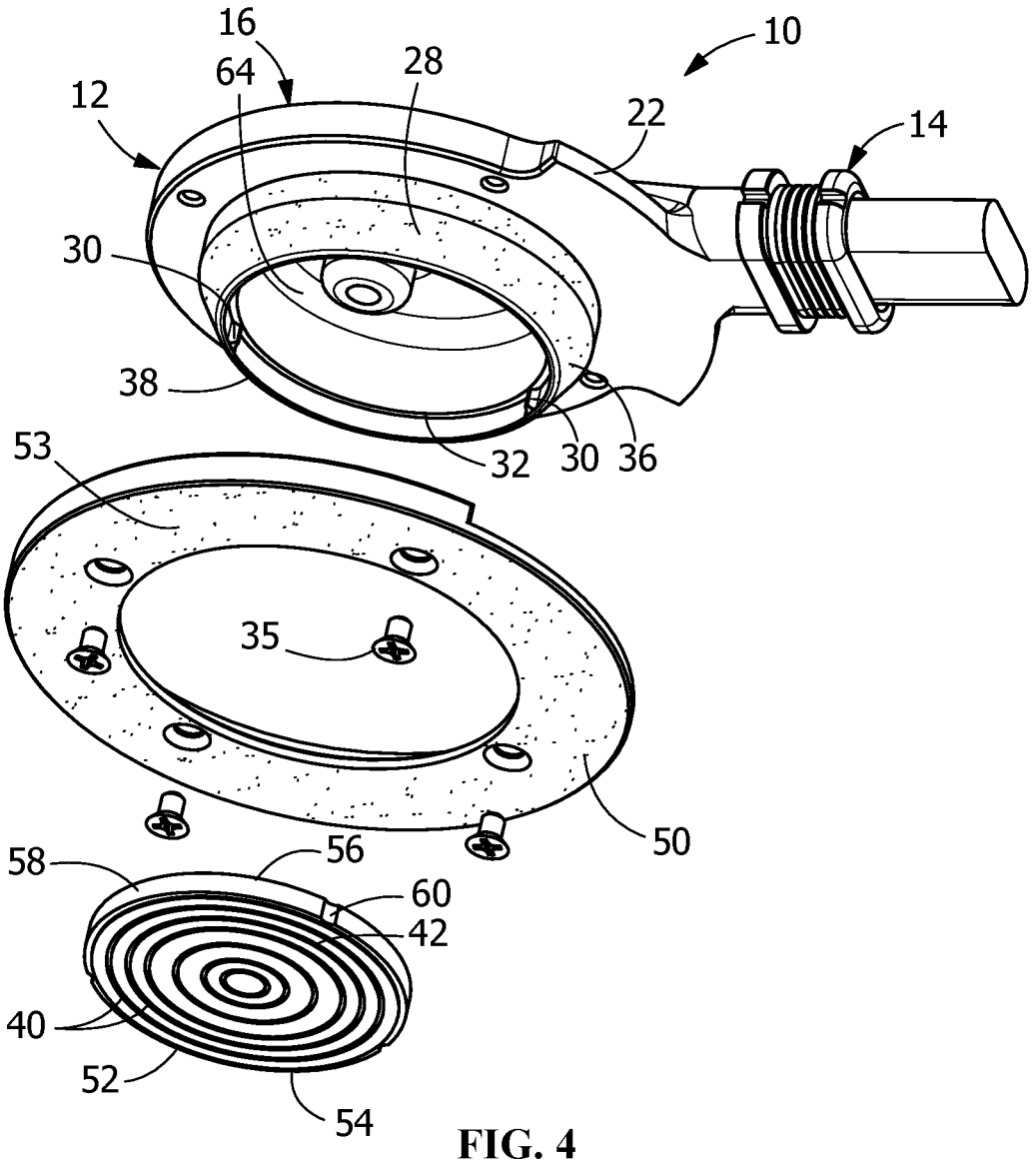
FIG. 4 is an exploded view of the electrical connector assembly of FIG. 1.

As shown in FIGS. 2 and 4, a mating projection 28 extends from the first surface 18 in a direction away from the second surface 20. The mating projection 28 has a generally circular cross-sectional configuration.

The mating projection 28 has an angled or sloped surface or wall 36 which extends from the first surface 18 to a mating face 38. Positioning or securing projections 30 (FIG. 4) are provided on an inside surface of the angled or sloped wall 36. A positioning shoulder 32 extends about the circumferences of the inside surface of the angled or sloped wall 36. The positioning shoulder 32 is spaced from the mating face 38.

The angled or sloped wall 36 is angled relative to the first surface 18 and the mating face 38. While the angle may vary depending upon the length of the mating projection 28, in the illustrative embodiment shown, the angled or sloped wall 36 is angled 31 approximately 25 to 50 degrees relative to the mating face 38. The angled or sloped wall 36 is angled 31 less than 90 degrees relative to the mating face 38. A nonconductive coating 33 may be applied to the angled or sloped wall 36.

One or more metallic members 50 are provided on the first surface 18. The one or more metallic members 50 are positioned about at least a portion of the circumference of the outside surface of the angled or sloped wall 36. In the illustrative embodiment shown, the one or more metallic members 50 are a ring 50 which extends about the entire circumference of the outside surface of the angled or sloped wall 36. The one or more metallic members 50 can be made of any material which provides a magnetic attraction to magnets provided in the mating electrical connector assembly 110. The nonconductive coating 33 may also be applied to the one or more metallic members 50. The one or more metallic members 50 one or more metallic members 50 may mounted using mounting hardware 35, or by other known mounting methods.

The illustrative metallic member 50 shown extends beyond the first surface 18 and is position proximate portions of the sidewalls 22 of the mating portion 16.

As shown in FIGS. 1 and 2, the cable receiving portion 14 extends from the mating portion 16. In the illustrative embodiment shown, cross-sections of the cable receiving portion 14 have a generally oval configuration. However, other configurations of the cable receiving portion 14 may be used.

Figure 3:
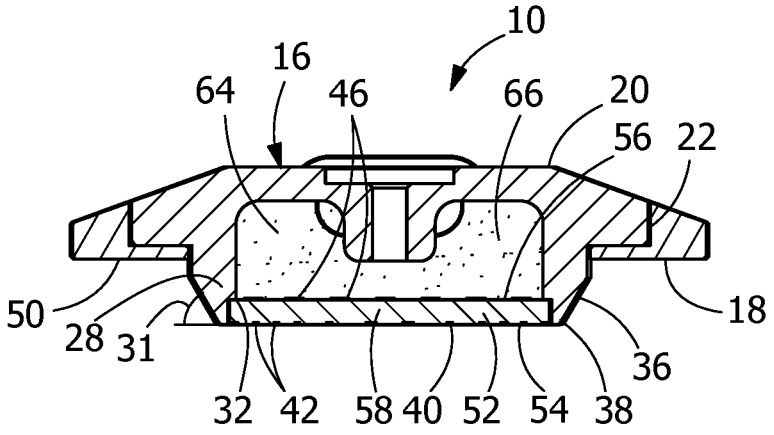
FIG. 3 is a cross-sectional view of the electrical connector assembly taken along line 3-3 of FIG. 1.

As shown in FIGS. 3 and 4, the electrical connector assembly 10 has a board or substrate 52 through which contacts 40 extend. The substrate 52 has a first surface 54 and an oppositely facing second surface 56. A side surface 58 extends between the first surface 54 and the second surface 56. Positioning recesses 60 are provided on the side surfaces 58.

Each of the contacts 40 have an engagement section 42, a transition section (not shown) and a wire termination section 46 (FIG. 3). The engagement sections 42 are circular tracks or contacts which are arranged concentrically about the center of the mating face 38.

As shown in FIG. 3, the substrate 52 is press fit into the interior of the housing 12 through the mating projection 28 and retained therein. The second surface 56 of the substrate 52 engages the positioning shoulder 32 to properly position the substrate 52 in the housing 12. In this position, the positioning or securing projections 30 are positioned in the positioning recesses 60 on the side surfaces 58 of the substrate. The interaction of the positioning projections 30 with the positioning recesses 60 maintains the substrate 52 relative to the housing 12. In this position, a cable receiving interior cavity 64 (FIG. 3) is provided to accommodate the ends of individual wires of the cable (not shown).

With the substrate 52 properly positioned, the first surface 54 of the substrate 52 forms a portion of the mating face 38. When assembled, the circular tracks or engagement sections 42 of the contacts 40 are positioned on the mating face 38, the transition sections (not shown) extend through the substrate 52, and the wire terminations section 46 are terminated to the wires of a cable. The termination of the wires to the wire terminations section 46 may be done by soldering or other known termination methods.

With the contacts 40 properly terminated and the board or substrate 52 properly positioned electrical connector assembly 10, an epoxy 66 is provide in an interior cavity 64 of the electrical connector assembly 10 to properly maintain the substrate 52 in position and to seal the interior cavity 64 to prevent moisture or debris from interfering with the connection between the termination sections 46 of the contacts 40 and the wires (not shown).

As shown in FIGS. 5 through 9, an illustrative mating electrical connector assembly 110 has a housing 112 with a cable receiving portion 114 and a mating portion 116. The housing 112 has a first surface 118 and an oppositely facing second surface 120. Sidewalls 122 extend between the first surface 118 and the second surface 120.

Figure 5:
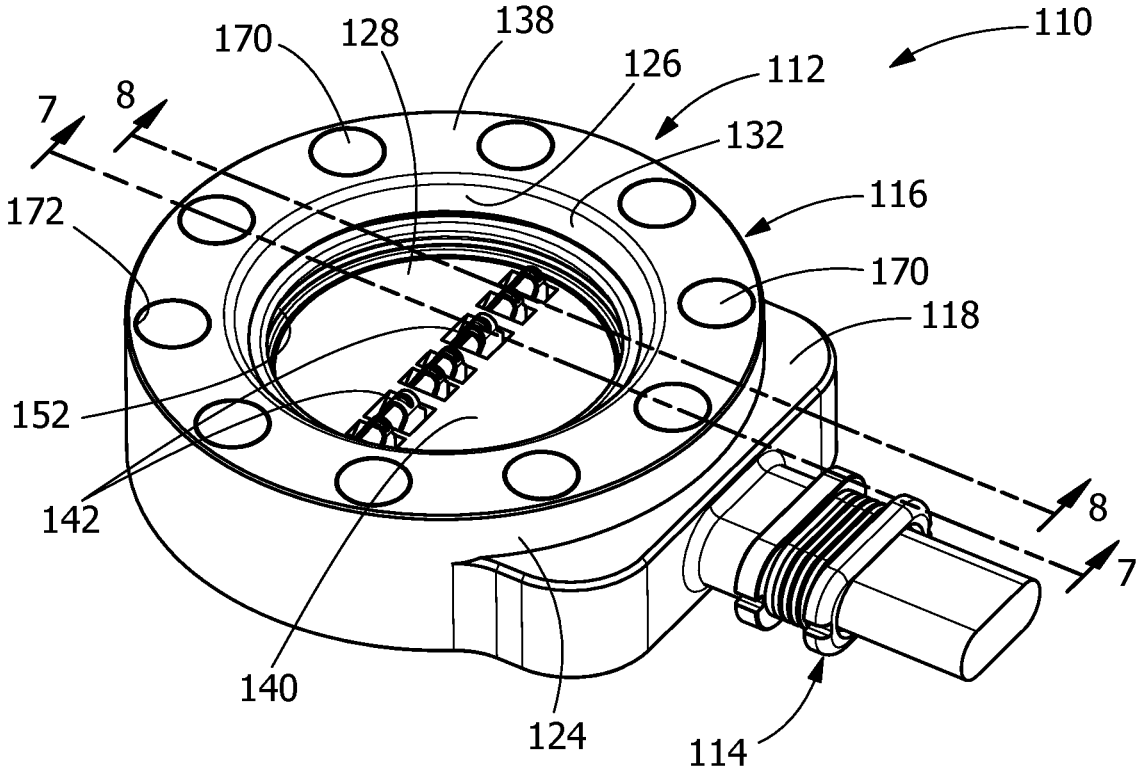
FIG. 5 is a top perspective view of an illustrative embodiment of a mating electrical connector assembly of the present invention.

As shown in FIG. 5, the mating portion 116 has a mating projection 124 that extends from the first surface 118 in a direction away from the second surface 120 to a mating surface 138. The mating projection 124 has a circular cross-sectional configuration and has a side wall 126. The side wall 126 forms a mating recess 128 which extends from the mating surface 138 toward the second surface 120. The mating recess 128 has a generally circular configuration.

An angled or sloped surface or portion 132 of the sidewall 126 extends from the mating surface 138 to a mating face 140. The angled or sloped portion 132 is angled relative to the mating surface 138 and the mating face 140. While the angle may vary depending upon the depth of the mating recess 128, in the illustrative embodiment shown, the angled or sloped portion 132 is angled approximate 25 to 50 degrees relative to the mating face 140. The angled or sloped portion 132 is angled 131 less than 90 degrees relative to the mating face 138. The angle of the angled or sloped portion 132 is configured to be approximately equal to the angle of the angled or sloped wall 36 of the mating projection 28 of the connector assembly 10.

The mating face 140 has contacts 142 provided thereon or extending therethrough. In this illustrative embodiment shown in FIGS. 7 and 8, the contacts 142 have mating sections 144, a transition sections 146 and wire termination sections 148.

Figure 7:
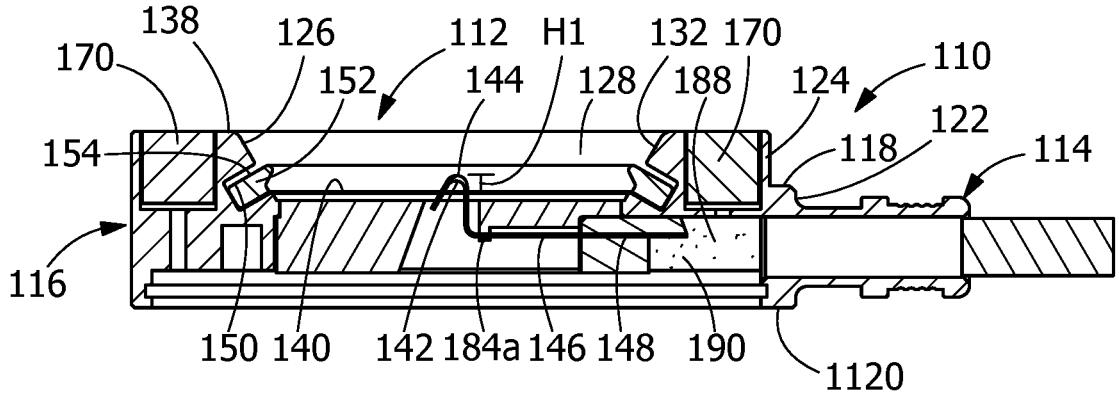
FIG. 7 is a cross-sectional view of the mating electrical connector assembly taken along line 7-7 of FIG. 5.
Figure 8:
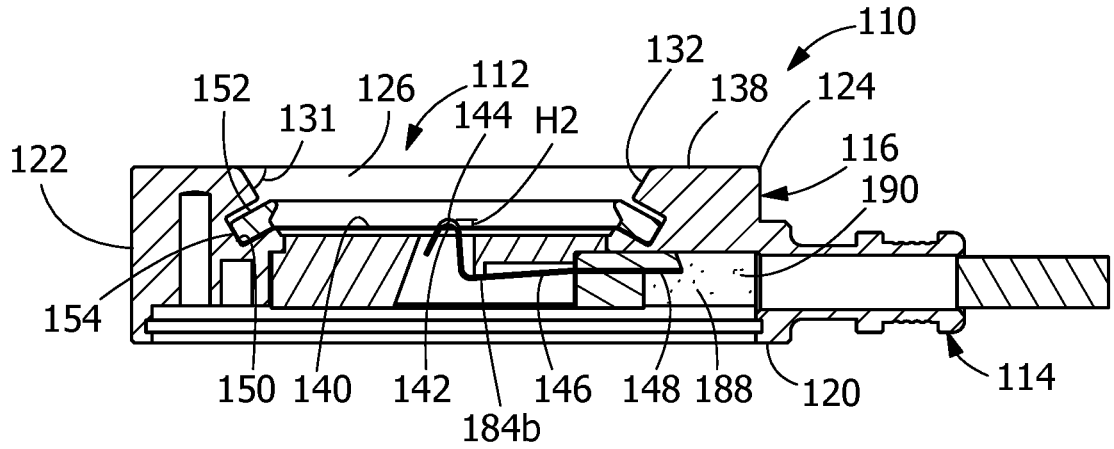
FIG. 8 is a cross-sectional view of the mating electrical connector assembly taken along line 8-8 of FIG. 5.

As shown in FIGS. 5, 7 and 8, the angled or sloped portion 132 has a circumferential seal receiving recess 150. A seal 152 is positioned in the seal receiving recess 150. A back wall 154 of the seal receiving recess 150 is angled at approximately the same angle as the angled or sloped surface 132 is angled relative to the mating face 140.

Magnets 170 are positioned in magnet receiving openings 172. In the illustrative embodiment shown the magnets 170 are spaced about the circumference of the mating recess 128. Ten magnets 170 and magnet receiving openings 172 are shown, but other numbers of magnets and magnet receiving opening may be provided. Also, in the illustrative embodiment shown, the magnet receiving openings 172 extend from the mating surface 138. However, the magnet receiving openings 172 may be provided in the second surface 120 and extend toward the mating surface 138.

Figure 6:
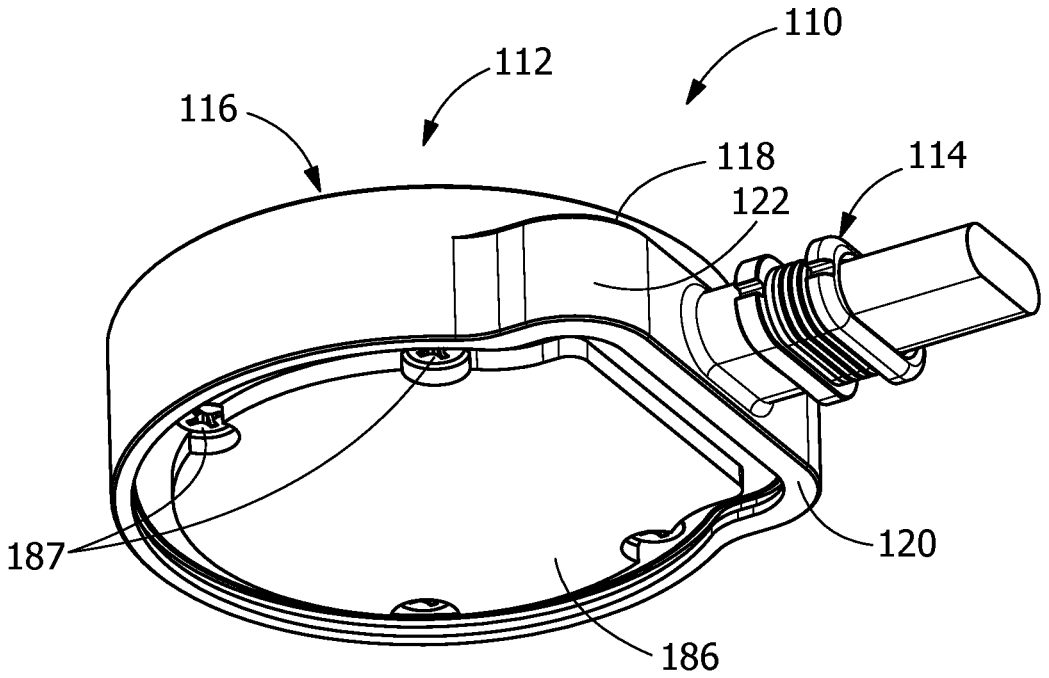
FIG. 6 is a bottom perspective view of the mating electrical connector assembly of FIG. 5.

As shown in FIGS. 5 and 6, the cable receiving portion 114 extends from the mating portion 116. In the illustrative embodiment shown, cross-sections of the cable receiving portion 114 have a generally oval configuration. However, other configurations of the cable receiving portion 114 may be used.

Figure 9:
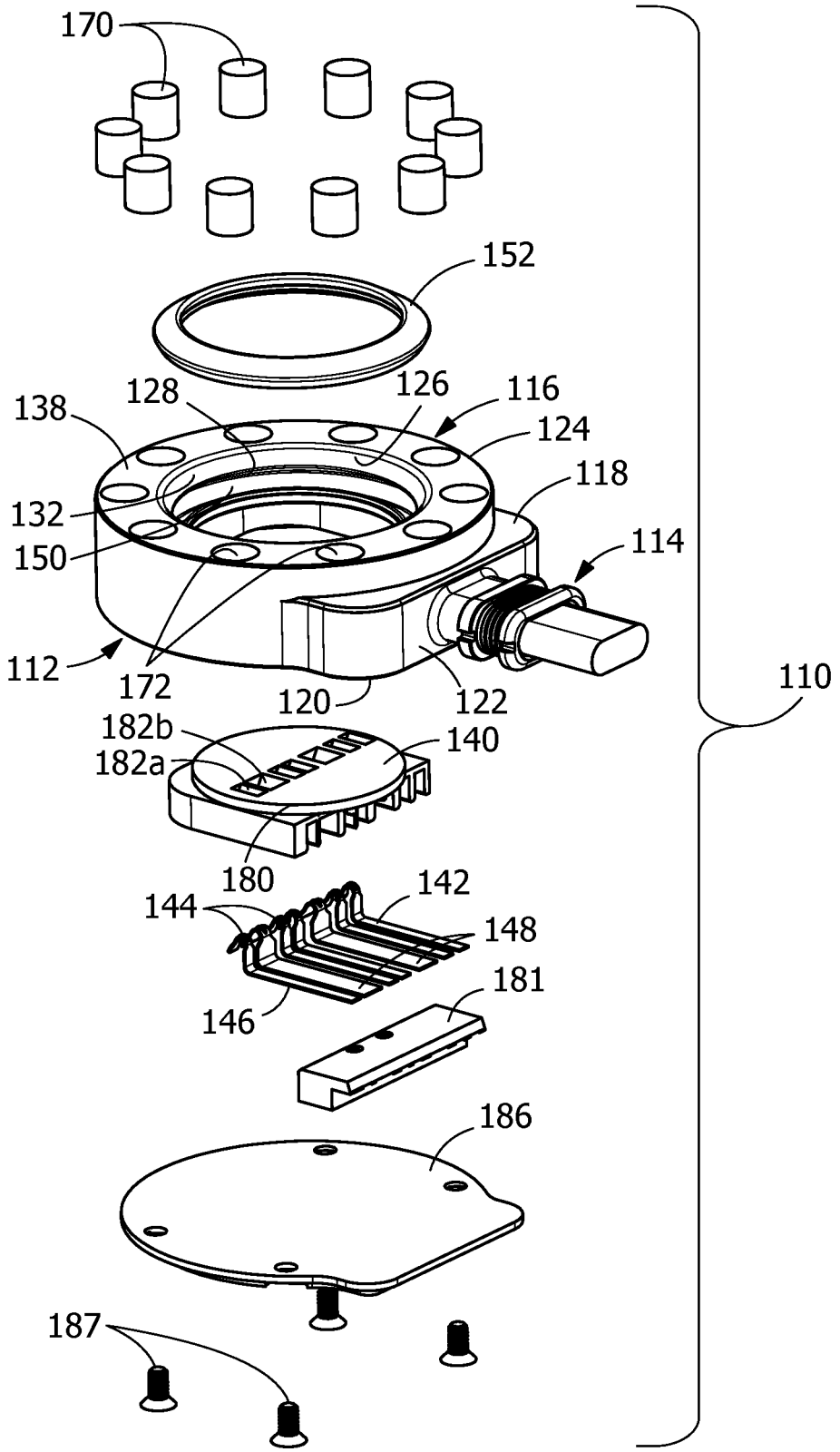
FIG. 9 is an exploded view of the mating electrical connector assembly of FIG. 5.

As shown in FIG. 9, in the illustrative embodiment shown, the connector assembly 110 has a first contact receiving member 180 and a second contact receiving member 181 which are used to properly position and retain the contacts 142 in position. A surface of the first contact receiving member 180 is the mating face 140.

The first contact receiving member 180 has openings 182*a*, 182*b* which extend therethrough and which are configured to receive the mating sections 144 of the contacts 142 therein. As shown in FIGS. 7 and 8, openings 182*a* have a smaller projection 184*a* which cooperates with the transition portions 146 of the contacts 142 to allow the transition portions 146 to be positioned essentially parallel to the mating face 140. This allows the resilient mating sections 144 of the contacts 142 in openings 182*b* to extend a height H1 above the mating face 140. Openings 182*b* have a larger projection 184*b* which cooperates with the transition portions 146 of the contacts 142 to allow the transition portions 146 to be positioned at an angle relative to the mating face 140. This allows the mating sections 144 of the contacts 142 in openings 182*a* to extend a height H2 above the mating face 140.

While the mating portions 144 of the contacts 142 are retained in an initial position, the mating portions 144 and the transition portions 146 are able to move in a direction which is parallel to the direction of mating of the connector assembly 10 with the connector assembly 110 to allow the contacts 142 to be resiliently moved as insertion occurs.

A cover 186 is provided on the second surface 120 of the connector assembly 110. When assembled the cover 186 is mounted with hardware 187 and defines a cable receiving interior cavity 188 which accommodates the ends of individual wires of the cable (not shown).

With the contacts 142 properly terminated and the components properly positioned electrical connector assembly 110, an epoxy 190 is provided in an interior cavity 188 of the electrical connector assembly 110 and epoxy 192 is provided in exterior cavity 194 to properly maintain the components in position and to seal the interior cavity 188 to prevent moisture or debris from interfering with the connection between the termination sections 148 of the contacts 142 and the wires (not shown).

While illustrative contacts 142 are shown and described above, other types of contacts may be used. For example, the contacts 142 may be spring probes. Spring probes would require only one contact receiving member, as the spring probes could be press fit into the contact receiving member with wires soldered on wire termination sections which are provided on ends of the contacts which are opposite the mating portions of the contacts.

Figure 10:
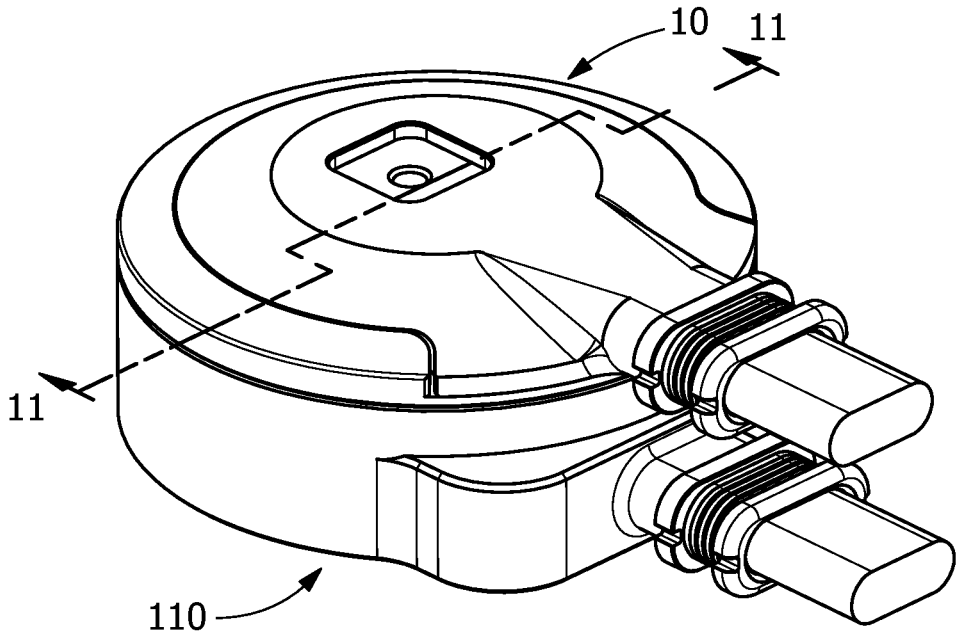
FIG. 10 is a top perspective view of the electrical connector assembly of FIG. 1 mated with the mating connector assembly of FIG. 5.
Figure 11:
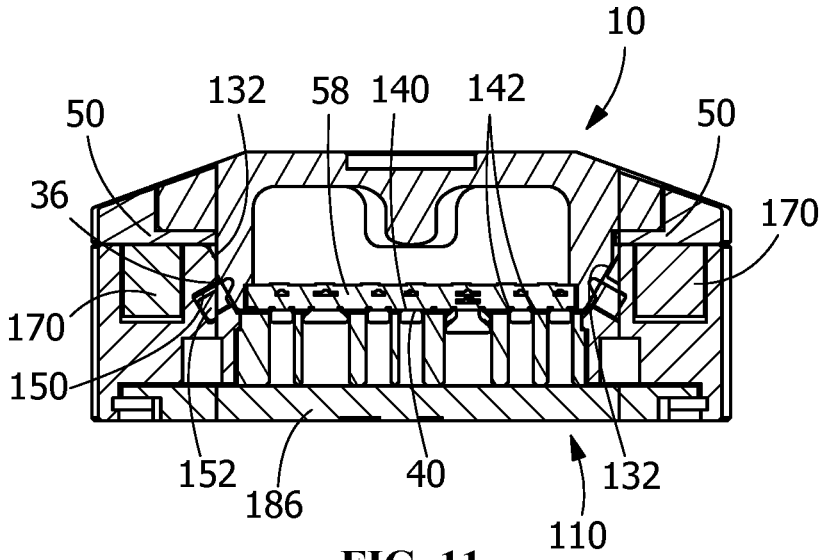
FIG. 11 is a cross-sectional view of the mating electrical connector assembly and mated with the mating connector assembly taken along line 11-11 of FIG. 10.

In use, the connector assembly 10 and mating connector assembly 110 are mated together to form a mechanical and electrical connection therebetween, as shown in FIGS. 10 and 11. As the engagement sections 42 of the contacts 40 are circular tracks or contacts which are arranged concentrically about the center of the mating face 38, and as the mating projection 28 and the mating recess 128 are circular, the connector assembly 10 may be mounted to the mating connector assembly 110 from any orientation (360 degrees) to make the mechanical and electrical engagement. In addition, the connector assembly 10 may be rotated relative to the mating connector assembly 110.

As the connector assembly 10 is moved into engagement with the connector assembly 110, the angled or sloped wall 36 of the connector assembly 10 engages the seal 152 positioned on the angled or sloped portion 132 of the mating connector assembly 110. The magnetic member 50 is attracted toward the magnets 170 to help align and mate the connector assembly 10 with the connector assembly 110.

As the mating occurs, the mating sections 144 of the contacts 142 positioned in openings 182*a* engage the engagement sections 42 of the contacts 40 prior to the mating sections 144 of the contacts 142 positioned in openings 182*b* engage the engagement sections 42 of the contacts 40. This allow the mating sections 144 of the contacts 142 positioned in openings 182*a* to make electrical engagement with respective engagement sections 42 of the contacts 40 prior to the mating sections 144 of the contacts 142 positioned in openings 182*b* making electrical engagement with other respective engagement sections 42 of the contacts 40

With the mating projection 28 fully inserted into the mating recess 128, the magnetic force between the magnets 170 and the magnetic member 50 allows the assembly 10 and the assembly 110 to be retained in mechanical engagement, and the contacts 40 and contacts 142 to be retained in mechanical and electrical engagement. In one illustrative embodiment, the magnetic force applied by the magnets 170 is between approximately 10 to 20 lbs., and preferably approximately 12 lbs., providing a minimum retention force to disconnect assembly 10 from assembly 110 of approximate 6 to 8 lbs.

In various other embodiments, the retention force is configured to be small, in the range of between 1-5 lbs. to allow the connector assembly 10 to be easily removed from the mating connector assembly 110 when a force is applied to either the connector assembly 10 or the mating connector assembly 110. In other embodiments, the retention force is configured to be large, in the range of between 5-15 lbs., to prevent the connector assembly 10 from being easily removed from the mating connector assembly 110 when a force is applied to either the connector assembly 10 or the mating connector assembly 110.

In various environments, it is important that the connector assembly 10 be allowed to be mated from any direction and be removed or break away from the mating connector assembly 110 when a designated amount of force is applied from any direction to the connector assembly 10 or the mating connector assembly 110. To allow the connector assembly 10 and mating connector assembly 110 to be properly released in different directions, the retention force of the securing member 172 and the angles of the angled or sloped wall 36 and the angled or sloped portion 132 must be controlled.

Accordingly, the electrical connector or connector assembly, as described herein, can be mounted from any direction, without the need for pre-alignment, and can be easily broken away from the mating connector, connector assembly upon the application of designated force, regardless of the direction the force is applied to the connector or connector assembly. The ability to mate and release in different directions allows the connector assembly to be used in many applications or environments to prevent damage to the equipment and prevent harm to the user.

Figure 12:
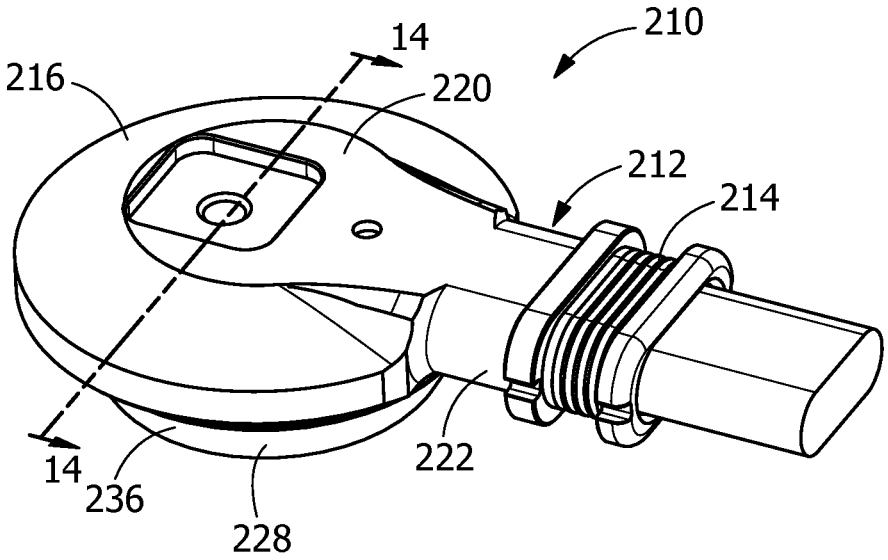
FIG. 12 is a bottom perspective view of alternate illustrative embodiment of an electrical connector assembly of the present invention.
Figure 13:
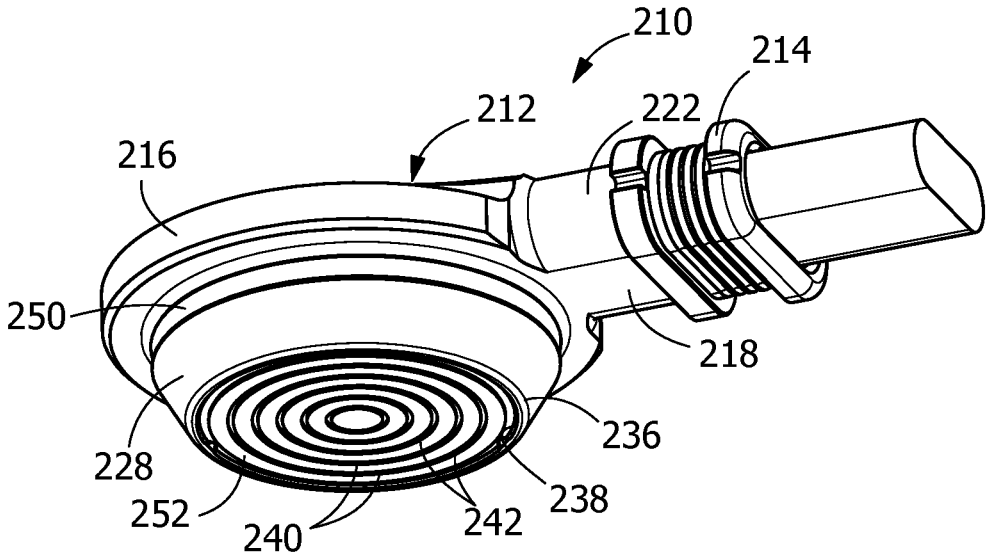
FIG. 13 is a top perspective view of the electrical connector assembly of FIG. 12.

As shown in FIGS. 12 and 13, an alternate illustrative electrical connector assembly 210 has a housing 212 with a cable receiving portion 214 and a mating portion 216. The housing 212 has a first surface 218 and an oppositely facing second surface 220. Sidewalls 222 extend between the first surface 218 and the second surface 220.

In the illustrative embodiment shown, the mating portion 216 have a circular configuration. However, the mating portion 216 may have other configurations without departing from the scope of the invention.

Figure 15:
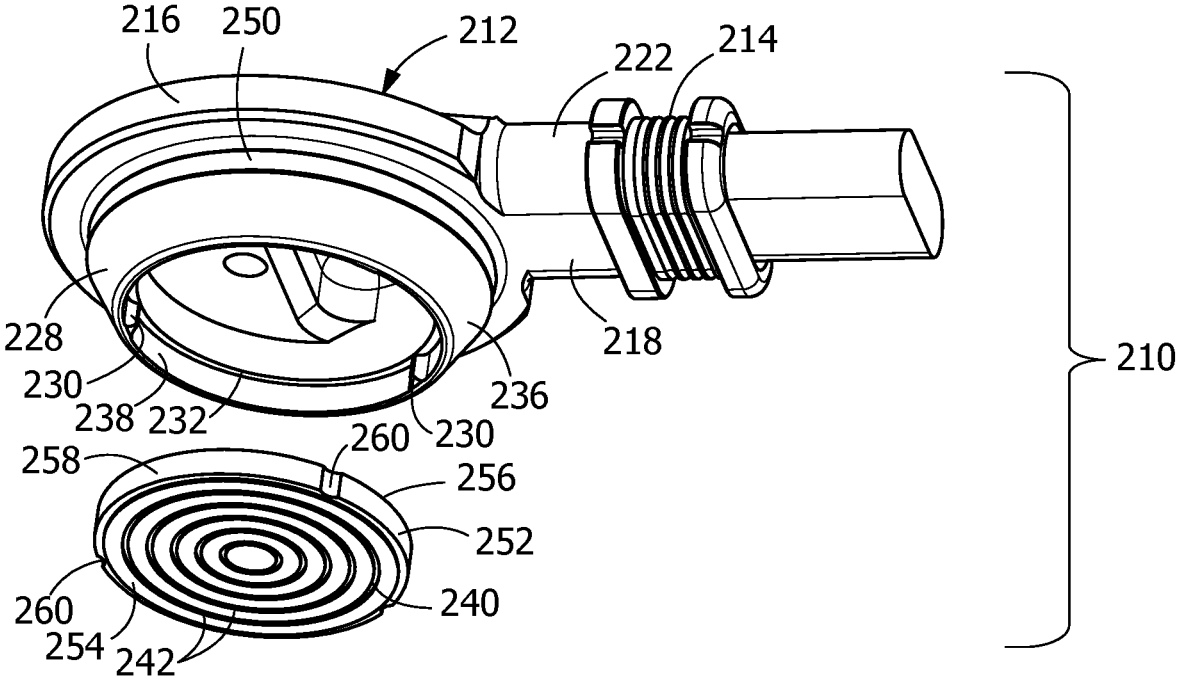
FIG. 15 is an exploded view of the electrical connector assembly of FIG. 12.

As shown in FIGS. 13 and 15, a mating projection 228 extends from the first surface 218 in a direction away from the second surface 220. The mating projection 228 has a generally circular cross-sectional configuration.

The mating projection 228 has an angled or sloped surface or wall 236 which extends from the first surface 218 to a mating face 238. Positioning or securing projections 230 (FIG. 15) are provided on an inside surface of the angled or sloped wall 236. A positioning shoulder 232 extends about the circumferences of the inside surface of the angled or sloped wall 236. The positioning shoulder 232 is spaced from the mating face 238.

The angled or sloped wall 236 is angled relative to the first surface 218 and the mating face 238. While the angle may vary depending upon the length of the mating projection 228, in the illustrative embodiment shown, the angled or sloped wall 236 is angled approximate 25 to 50 degrees relative to the mating face 238.

A securing or clip-receiving recess 250 is provided on an outside surface of the angled or sloped wall 236. The securing or clip-receiving recess 250 extends about the outside circumference of the angled or sloped wall 236. In the illustrative embodiment shown, the securing or clip-receiving recess 250 is provide proximate or adjacent to the first surface 218.

As shown in FIGS. 12 and 13, the cable receiving portion 214 extends from the mating portion 216. In the illustrative embodiment shown, cross-sections of the cable receiving portion 214 have a generally oval configuration. However, other configurations of the cable receiving portion 214 may be used.

Figure 14:
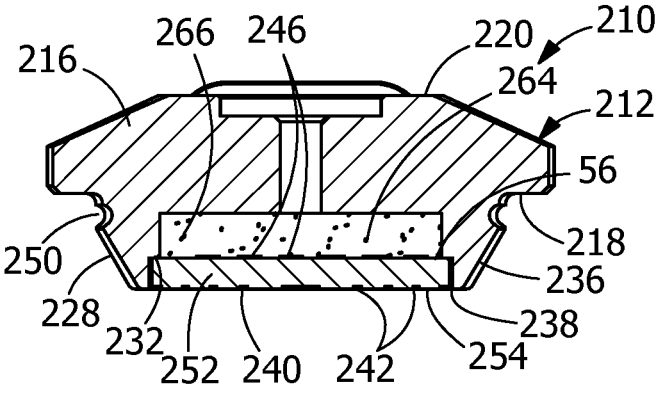
FIG. 14 is a cross-sectional view of the electrical connector assembly taken along line 14-14 of FIG. 12.

As shown in FIGS. 14 and 15, the electrical connector assembly 210 has a board or substrate 252 through which contacts 240 extend. The substrate 252 has a first surface 254 and an oppositely facing second surface 256. A side surface 258 extends between the first surface 254 and the second surface 256. Positioning recesses 260 are provided on the side surfaces 258.

Each of the contacts 40 have an engagement section 242, a transition section (not shown) and a wire termination section 246 (FIG. 14). The engagement sections 242 are circular tracks or contacts which are arranged concentrically about the center of the mating face 238.

As shown in FIG. 14, the substrate 252 is press fit into the interior of the housing 212 through the mating projection 228 and retained therein. The second surface 256 of the substrate 252 engages the positioning shoulder 232 to properly position the substrate 252 in the housing 212. In this position, the positioning or securing projections 230 are positioned in the positioning recesses 260 on the side surfaces 258 of the substrate. The interaction of the positioning projections 230 with the positioning recesses 260 maintains the substrate 252 relative to the housing 212. In this position, a cable receiving interior cavity 264 (FIG. 14) is provided to accommodate the ends of individual wires of the cable (not shown).

With the substrate 252 properly positioned, the first surface 254 of the substrate 252 forms a portion of the mating face 238. When assembled, the circular tracks or engagement sections 242 of the contacts 240 are positioned on the mating face 238, the transition sections (not shown) extend through the substrate 252, and the wire terminations section 246 are terminated to the wires of a cable. The termination of the wires to the wire terminations section 246 may be done by soldering or other known termination methods.

With the contacts 240 properly terminated and the board or substrate 252 properly positioned electrical connector assembly 210, an epoxy 266 is provide in an interior cavity 264 of the electrical connector assembly 210 to properly maintain the substrate 252 in position and to seal the interior cavity 264 to prevent moisture or debris from interfering with the connection between the termination sections 246 of the contacts 240 and the wires (not shown).

As shown in FIGS. 16 through 20, an alternate illustrative mating electrical connector assembly 310 has a housing 312 with a cable receiving portion 314 and a mating portion 316. The housing 312 has a first surface 318 and an oppositely facing second surface 320. Sidewalls 322 extend between the first surface 318 and the second surface 320.

Figure 16:
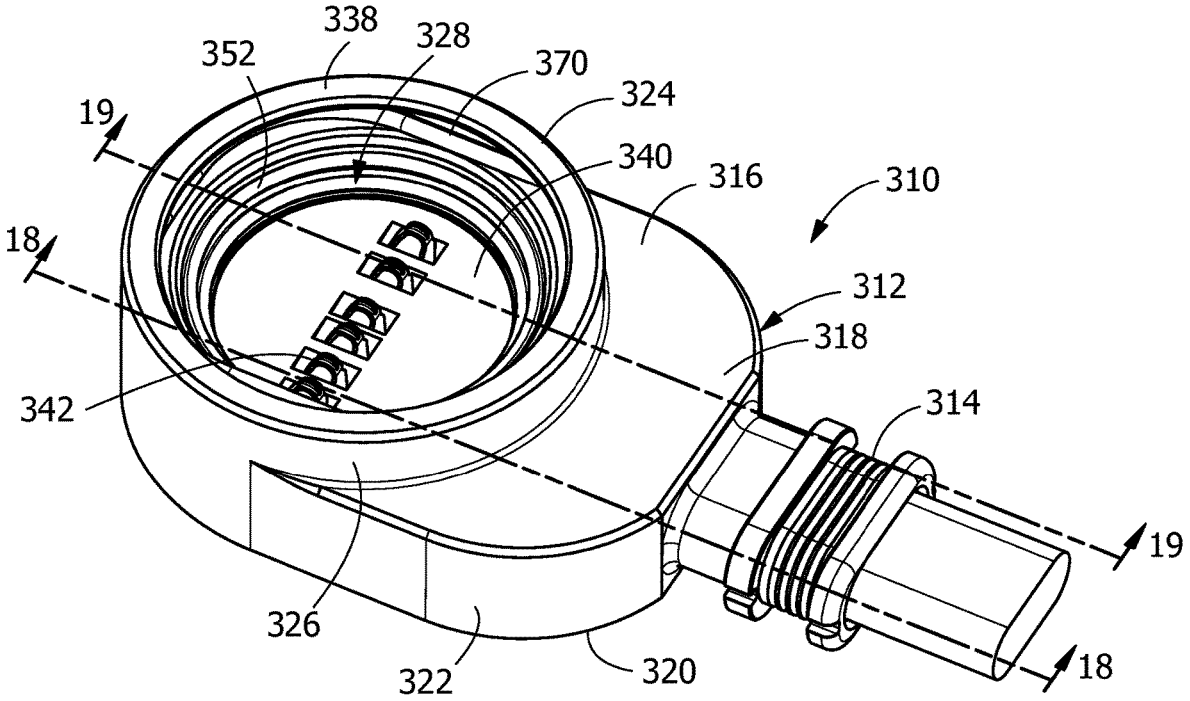
FIG. 16 is a top perspective view of an alternate illustrative embodiment of a mating electrical connector assembly of the present invention.

As shown in FIG. 16, the mating portion 316 has a mating projection 324 that extends from the first surface 318 in a direction away from the second surface 320 to a mating surface 338. The mating projection 324 has a circular cross-sectional configuration and has a side wall 326. The side wall 326 forms a mating recess 328 which extends from the mating surface 338 toward the second surface 320. The mating recess 328 has a generally circular configuration.

An angled or sloped surface or portion 332 of the sidewall 326 extends from the mating surface 338 to a mating face 340. The angled or sloped portion 332 is angled relative to the mating surface 338 and the mating face 340. While the angle may vary depending upon the depth of the mating recess 328, in the illustrative embodiment shown, the angled or sloped portion 332 is angled approximate 25 to 50 degrees relative to the mating face 340. The angle of the angled or sloped portion 332 is configured to be approximately equal to the angle of the angled or sloped wall 236 of the mating projection 228 of the connector assembly 210.

The mating face 340 has contacts 342 provided thereon or extending therethrough. In this illustrative embodiment shown in FIGS. 18 and 19, the contacts 342 have mating sections 344, a transition sections 346 and wire termination sections 348.

Figure 18:
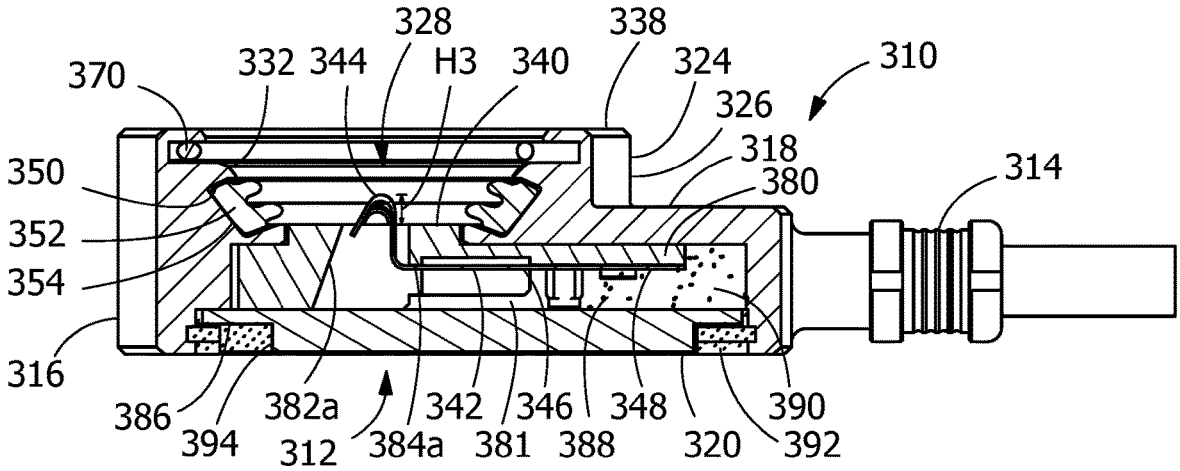
FIG. 18 is a cross-sectional view of the mating electrical connector assembly taken along line 18-18 of FIG. 16.
Figure 19:
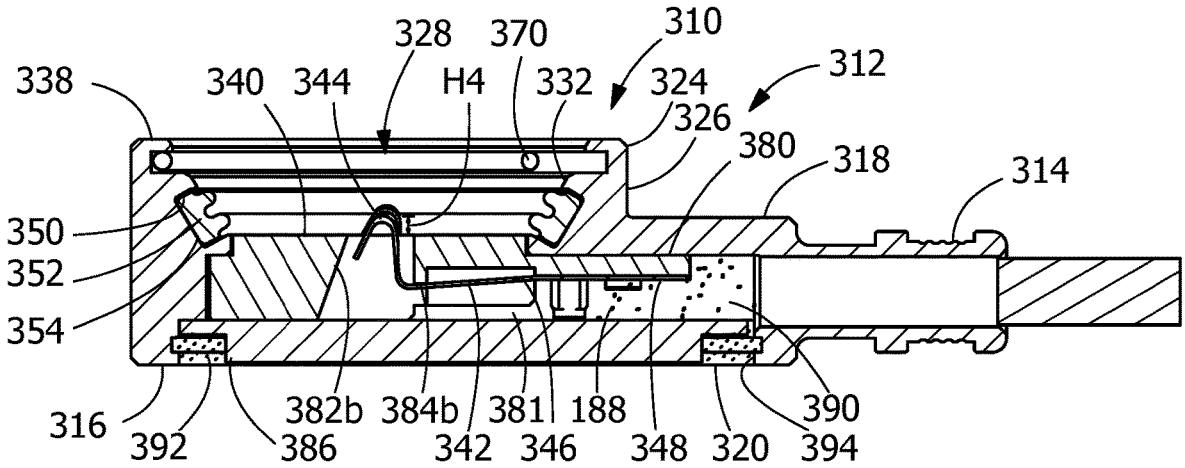
FIG. 19 is a cross-sectional view of the mating electrical connector assembly taken along line 19-19 of FIG. 16.

As shown in FIGS. 16, 18 and 19, the angled or sloped portion 332 has a circumferential seal receiving recess 350. A seal 352 is positioned in the seal receiving recess 350. A back wall 354 of the seal receiving recess 350 is angled at approximately the same angle as the angled or sloped surface 332 is angled relative to the mating face 340.

Figure 20:
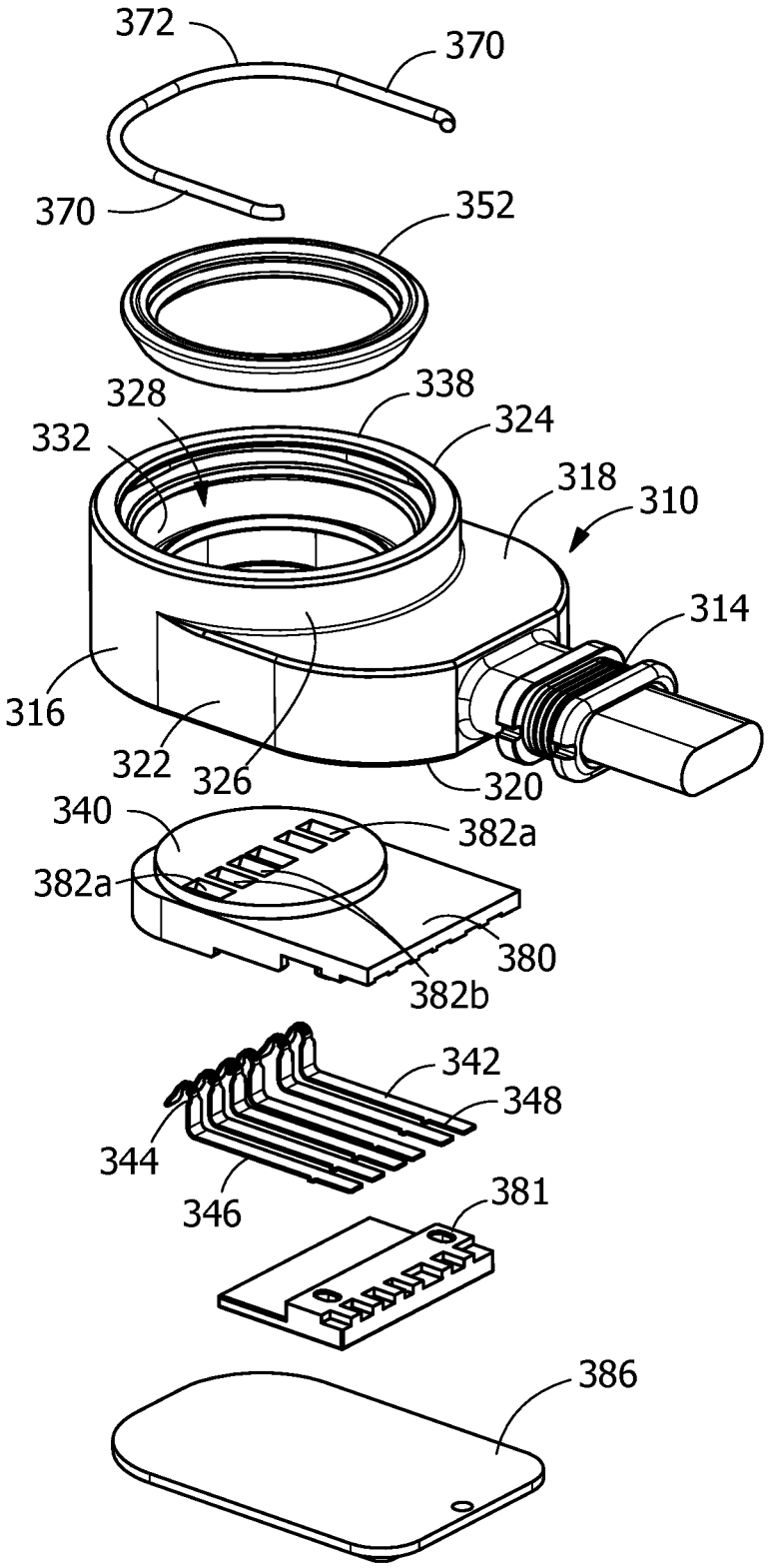
FIG. 20 is an exploded view of the mating electrical connector assembly of FIG. 16.

Legs 370 of a resilient securing member 372 are provided in the mating recess 328. The legs 370 are a portion of a U-shaped resilient securing member 372 (FIG. 20). The legs 370 are resiliently deformable away from a longitudinal axis of the mating recess 328 as the mating projection 228 of connector assembly 210 is positioned in the mating recess 328 of mating connector assembly 310, as will be more fully described.

Figure 17:
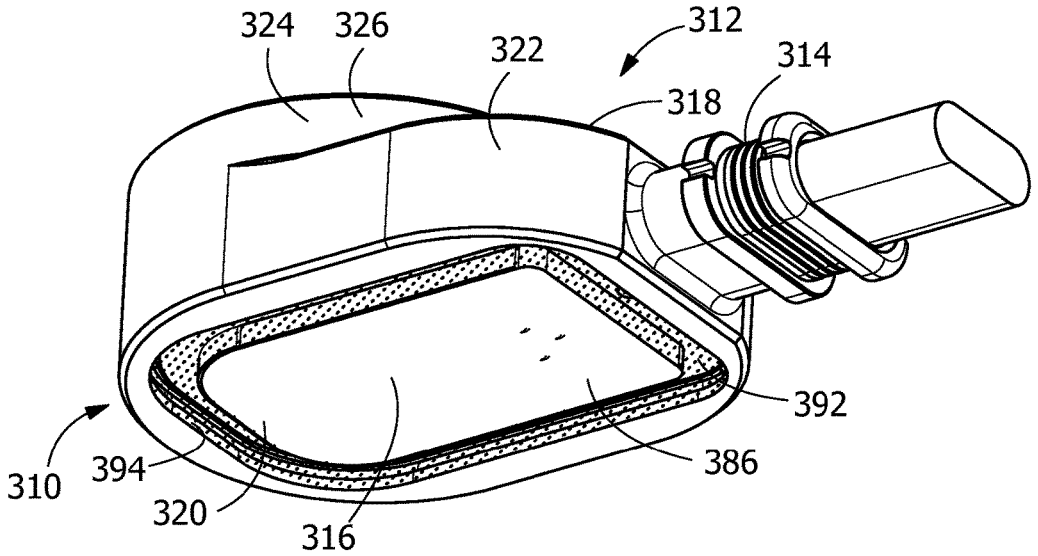
FIG. 17 is a bottom perspective view of the mating electrical connector assembly of FIG. 16.

As shown in FIGS. 16 and 17, the cable receiving portion 314 extends from the mating portion 316. In the illustrative embodiment shown, cross-sections of the cable receiving portion 314 have a generally oval configuration. However, other configurations of the cable receiving portion 314 may be used.

In the illustrative embodiment shown, the connector assembly 310 has a first contact receiving member 380 and a second contact receiving member 381 which are used to properly position and retain the contacts 342 in position. A surface of the first contact receiving member 380 is the mating face 340.

The first contact receiving member 380 has openings 382*a*, 382*b* which extend therethrough and which are configured to receive the mating sections 344 of the contacts 342 therein. Openings 382*a* have a smaller projection 384*a* which cooperates with the transition portions 346 of the contacts 342 to allow the transition portions 346 to be positioned essentially parallel to the mating face 340. This allows the resilient mating sections 344 of the contacts 342 in openings 382*b* to extend a height H3 above the mating face 340. Openings 382*b* have a larger projection 384*b* which cooperates with the transition portions 346 of the contacts 342 to allow the transition portions 346 to be positioned at an angle relative to the mating face 340. This allows the mating sections 344 of the contacts 342 in openings 382*a* to extend a height H4 above the mating face 340.

While the mating portions 344 of the contacts 342 are retained in an initial position, the mating portions 344 and the transition portions 346 are able to move in a direction which is parallel to the direction of mating of the connector assembly 210 with the connector assembly 310 to allow the contacts 342 to be resiliently moved as insertion occurs.

A cover 386 is provided on the second surface 320 of the connector assembly 310. When assembled the cover 386 defines a cable receiving interior cavity 388 which accommodates the ends of individual wires of the cable (not shown).

With the contacts 342 properly terminated and the components properly positioned electrical connector assembly 310, an epoxy 390 is provided in an interior cavity 388 of the electrical connector assembly 310 and epoxy 392 is provided in exterior cavity 394 to properly maintain the components in position and to seal the interior cavity 388 to prevent moisture or debris from interfering with the connection between the termination sections 348 of the contacts 342 and the wires (not shown).

While illustrative contacts 342 are shown and described above, other types of contacts may be used. For example, the contacts 342 may be spring probes. Spring probes would require only one contact receiving member, as the spring probes could be press fit into the contact receiving member with wires soldered on wire termination sections which are provided on ends of the contacts which are opposite the mating portions of the contacts.

Figure 21:
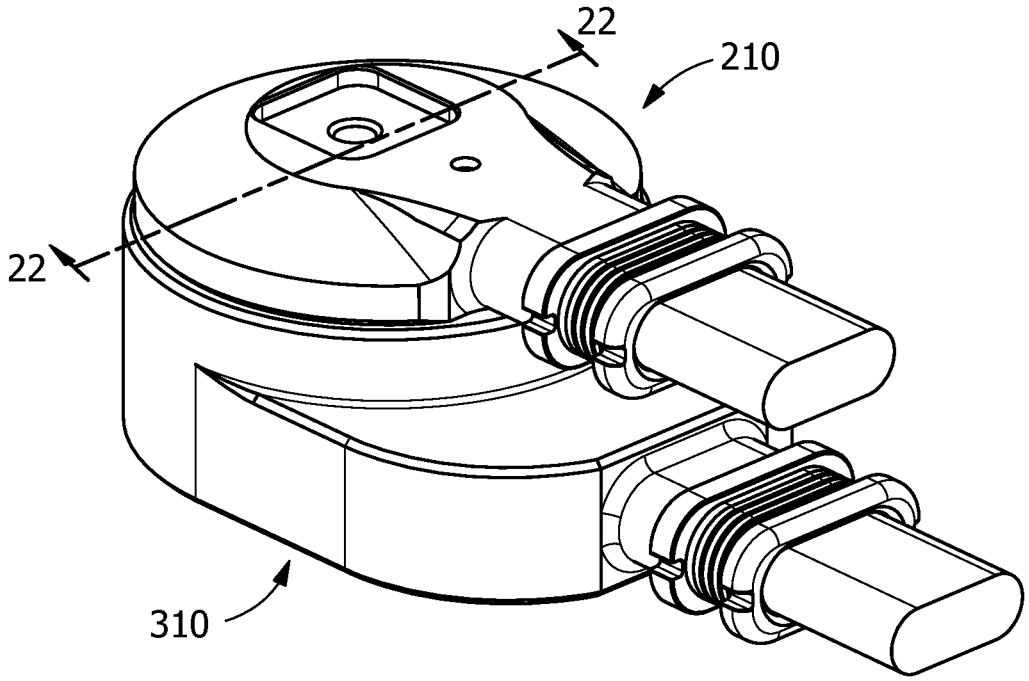
FIG. 21 is a top perspective view of the electrical connector assembly of FIG. 12 mated with the mating connector assembly of FIG. 16.
Figure 22:
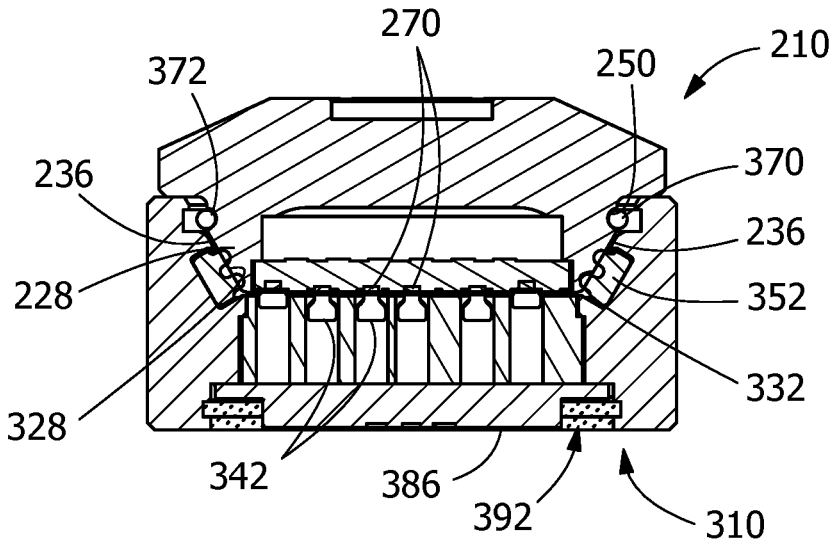
FIG. 22 is a cross-sectional view of the mating electrical connector assembly and mated with the mating connector assembly taken along line 22-22 of FIG. 21.

In use, the connector assembly 210 and mating connector assembly 310 are mated together to form a mechanical and electrical connection therebetween, as shown in FIGS. 21 and 22. As the engagement sections 242 of the contacts 240 are circular tracks or contacts which are arranged concentrically about the center of the mating face 238, and as the mating projection 228 and the mating recess 328 are circular, the connector assembly 210 may be mounted to the mating connector assembly 310 from any orientation (360 degrees) to make the mechanical and electrical engagement. In addition, the connector assembly 210 may be rotated relative to the mating connector assembly 310.

As the connector assembly 210 is moved into engagement with the connector assembly 310, the angled or sloped wall 236 of the connector assembly 210 engages the seal 352 positioned on the angled or sloped portion 332 of the mating connector assembly 310. The legs 370 of the resilient securing member 372 are moved outward as the mating projection 228 is inserted into the mating recess 328.

As the mating occurs, the mating sections 344 of the contacts 342 positioned in openings 382*a* engage the engagement sections 242 of the contacts 240 prior to the mating sections 344 of the contacts 342 positioned in openings 382*b* engage the engagement sections 242 of the contacts 240. This allow the mating sections 344 of the contacts 342 positioned in openings 382*a* to make electrical engagement with respective engagement sections 242 of the contacts 240 prior to the mating sections 344 of the contacts 342 positioned in openings 382*b* making electrical engagement with other respective engagement sections 242 of the contacts 240.

With the mating projection 228 fully inserted into the mating recess 328, the legs 370 enter the securing recess 250 positioned in the sidewall 236 of the mating projection 228 of the connector assembly 210. As this occurs, the legs 370 move back toward their unstressed position, thereby exerting a retention force on the securing recess 250 and the mating projection 228 to retain the mating projection 228 in the mating recess 328, allowing the contacts 240 and contacts 342 to be retained in mechanical and electrical engagement.

The legs 370 of the resilient securing member 372 can be configured to allow the retention force to be configured for a particular implementation and a particular force as desired. In various embodiments, the retention force is configured to be small, in the range of between 1-5 lbs. to allow the connector assembly 210 to be easily removed from the mating connector assembly 310 when a force is applied to either the connector assembly 210 or the mating connector assembly 310. In other embodiments, the retention force is configured to be large, in the range of between 5-15 lbs., to prevent the connector assembly 210 from being easily removed from the mating connector assembly 310 when a force is applied to either the connector assembly 210 or the mating connector assembly 310.

In various environments, it is important that the connector assembly 210 be allowed to be mated from any direction and be removed or break away from the mating connector assembly 310 when a designated amount of force is applied from any direction to the connector assembly 210 or the mating connector assembly 310. To allow the connector assembly 210 and mating connector assembly 310 to be properly released in different directions, the retention force of the securing member 372 and the angles of the angled or sloped wall 236 and the angled or sloped portion 332 must be controlled.

Accordingly, the electrical connector or connector assembly, as described herein, can be mounted from any direction, without the need for pre-alignment, and can be easily broken away from the mating connector, connector assembly upon the application of designated force, regardless of the direction the force is applied to the connector or connector assembly. The ability to mate and release in different directions allows the connector assembly to be used in many applications or environments to prevent damage to the equipment and prevent harm to the user.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly for mating with a mating connector assembly, the connector assembly comprising:

a housing having a cable receiving portion and a mating portion, the housing having a first surface and an oppositely facing second surface;

the mating portion having a mating projection extending from the first surface in a direction away from the second surface, the mating projection having a circular cross-sectional configuration, the mating projection having an angled wall which extends from the first surface to a mating face, the angled wall being angled relative to a plane of the first surface and a plane of the mating face;

the mating face having contacts extending therethrough, the contacts having circular engagement sections arranged concentrically about a center of the mating face;

a nonconductive coating applied to the angled wall.

2. The electrical connector assembly as recited in claim 1, wherein the mating portion has one or more metallic members provided on the first surface of the housing proximate the mating projection.

3. The electrical connector assembly as recited in claim 2, wherein, the one or more metallic members are a metallic ring which extends about the circumference of the mating projection.

4. The electrical connector assembly as recited in claim 3, wherein the nonconductive coating is applied to the metallic ring.

5. The electrical connector assembly as recited in claim 1, wherein the mating portion has a circular configuration.

6. The electrical connector assembly as recited in claim 1, wherein the contacts have transition sections which extend from the engagement sections, and wire termination sections which extend from the transition sections.

7. The electrical connector assembly as recited in claim 1, wherein the angled wall is angled between 25 to 50 degrees relative to the mating face.

8. The electrical connector assembly as recited in claim 1, wherein the electrical connector assembly has a substrate through which the contacts extend, the substrate is press fit into an interior of the housing, a surface of the substrate is the mating face.

9. The electrical connector assembly as recited in claim 8, wherein an epoxy is provided in an interior cavity of the electrical connector assembly to properly maintain the substrate in position and to seal the interior cavity.

10. An electrical connector assembly for mating with a mating connector assembly, the connector assembly comprising:

a housing having a first surface and a second surface;

a mating recess extending from the first surface in a direction toward the second surface, the mating recess having a sloped surface, the sloped surface is sloped relative to a plane of the first surface of the housing;

contacts extending through a bottom surface of the mating recess, the contacts having a resilient mating section extending from the bottom surface in a direction toward the first surface of the housing;

a seal provided about a circumference of the mating recess; and a plurality of magnets provided about the circumference of the mating recess.

11. The electrical connector assembly as recited in claim 10, wherein the sloped surface extends from the proximate the first surface to the bottom surface of the mating recess, the sloped surface is angled relative to the first surface and the bottom surface.

12. The electrical connector assembly as recited in claim 10, wherein the sloped surface has a circumferential seal receiving recess, the seal is positioned in the seal receiving recess.

13. The electrical connector assembly as recited in claim 10, wherein the housing has a cable receiving portion and a mating portion, the mating recess is provided in the mating portion.

14. The electrical connector assembly as recited in claim 10, wherein the contacts have mating sections, transition sections and wire termination sections.

15. The electrical connector assembly as recited in claim 14, wherein the connector assembly has a first contact receiving member and a second contact receiving member which are used to properly position and retain the contacts in position, a surface of the first contact receiving member is the mating face.

16. The electrical connector assembly as recited in claim 15, wherein the first contact receiving member has first openings and second openings which extend therethrough and which are configured to receive the mating sections of the contacts therein, the first openings have a smaller projection which cooperates with the transition portions of the contacts to allow the transition portions to be positioned essentially parallel to the mating face, thereby allowing the resilient mating sections of the contacts in the first openings to extend a first height above the mating face, the second openings have a larger projection which cooperates with the transition portions of the contacts to allow the transition portions to be positioned at an angle relative to the mating face, thereby allowing the mating sections of the contacts in the second openings to extend a second height above the mating face.

17. The electrical connector assembly as recited in claim 16, wherein a cable receiving interior cavity is provided in the housing, an epoxy is provided in an interior cavity.

18. A breakaway electrical connector assembly comprising:

a first connector assembly comprising:

a housing having a cable receiving portion and a mating portion, the housing having a first surface and an oppositely facing second surface;

a mating projection extending from the first surface in a direction away from the second surface, the mating projection having a circular cross-sectional configuration, the mating projection having an angled wall which extends from the first surface to a mating face, the angled wall being angled relative to a plane of the first surface and a plane of the mating face;

the mating face having contacts extending therethrough, the contacts having circular engagement sections arranged concentrically about a center of the mating face;

one or more metallic members provided on the first surface of the housing proximate the mating projection; and a second connector assembly comprising:

a second housing having a first surface and a second surface;

a mating recess extending from the first surface of the second housing in a direction toward the second surface, the mating recess having a sloped surface, the sloped surface being sloped relative to a plane of the first surface of the second housing;

contacts extending through a bottom surface of the mating recess, the contacts having a resilient mating section extending from the bottom surface in a direction toward the first surface of the second housing;

a seal provided about a circumference of the mating recess; and a plurality of magnets provided about the circumference of the mating recess.

* * * * *